United States Patent [19]

van den Haak

[11] 3,964,421

[45] June 22, 1976

[54] ANCHOR

[76] Inventor: Rob van den Haak, Allegro 114, Krimpen aan den Ijssel, Netherlands

[22] Filed: Apr. 28, 1975

[21] Appl. No.: 572,687

[30] Foreign Application Priority Data

Dec. 10, 1974 United Kingdom ..... 53338/74

[52] U.S. Cl. ..... 114/208 R

[51] Int. Cl.[2] ..... B63B 21/40

[58] Field of Search ..... 114/207, 208 R, 206 R

[56] References Cited

UNITED STATES PATENTS

| | | | |
|---|---|---|---|
| 3,766,877 | 10/1973 | Beck | 114/208 R |
| 3,828,497 | 8/1974 | Vinycomb | 114/206 R |

FOREIGN PATENTS OR APPLICATIONS

| | | | |
|---|---|---|---|
| 809,949 | 4/1969 | Canada | 114/208 R |

*Primary Examiner*—Stephen G. Kunin
*Assistant Examiner*—Sherman D. Basinger
*Attorney, Agent, or Firm*—Ladas, Parry, von Gehr, Goldsmith & Deschamps

[57] ABSTRACT

An anchor provided with a shank which is pivotally connected to a hollow fluke construction near the center of gravity of the fluke construction, characterized in that the fluke construction is formed as a peripherally closed, substantially delta-shaped blade having a forwardly converging hydrofoil section with a forwardly and downwardly bending configuration terminating in a sharp front edge, and a truncated rear portion, and having a central opening for receiving the shank.

4 Claims, 3 Drawing Figures

ANCHOR

This invention relates to an anchor provided with a shank which is pivotally connected to a hollow fluke constructions near the centre of gravity of the fluke construction.

In an earlier embodiment the fluke construction comprises a pair of flukes, one at each side of the shank, which are interconnected at the rear side, beyond the shank, to integrate the structure, but it is now discovered that the strength and the holding power of the anchor can be improved by a further integration of the fluke construction and a further enlargement of the fluke surface within its outlines, and to that effect in the here proposed new embodiment the fluke construction is formed as a peripherally closed, substantially delta-shaped blade having a forwardly converging hydrofoil section with a forwardly and downwardly bending configuration terminating in a sharp front edge, and a truncated rear portion, and having a central opening for receiving the shank.

The two flukes of the earlier embodiment are now integrated to a closed delta-shaped fluke construction and due to its forwardly and downwardly bending form the new anchor is well adapted to dig itself into the ground.

A further aspect is that the shank has a sharply bent rear portion which is connected to the fluke construction, which bent shape of the shank facilitates the digging into the ground.

Preferably the bent shank portion has on its end at each side a trunnion which is adapted to be received through a bayonet joint slot in a socket in a vertical side plate of a shank support.

The construction is further so that at the bottom side the fluke is provided with slide plates which give the fluke the correct position for digging itself into the ground.

The present invention is described in more detail in the following specification with reference to an illustrative example thereof in the drawings.

Figure 1:
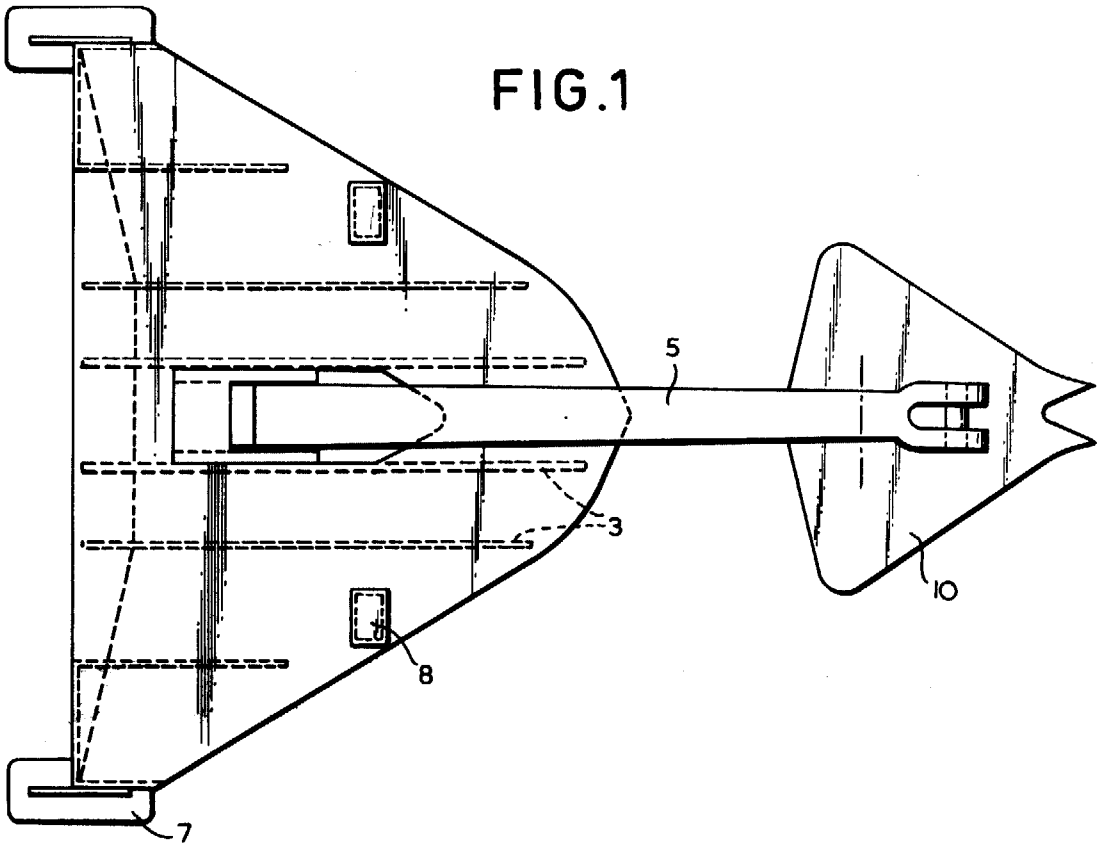
FIG. 1 is a plan view of the anchor.
Figure 2:
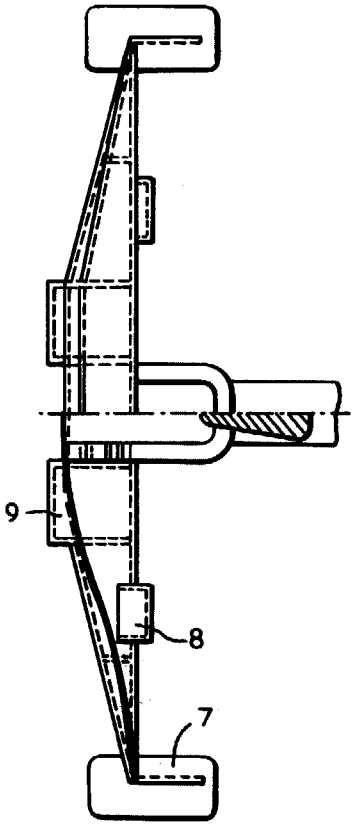
FIG. 2 is a rear view, in which in the lower half of the figure various cross section of the bottom plate of the fluke, of the shank, and of the central opening of the fluke, in which the shank is received, are shown.

As shown in the drawings the anchor is provided with a hollow fluke which is substantially delta-shaped in plan view, and has a top plate 1 and a bottom plate 2 with supporting ribs 3 therebetween.

Figure 3:
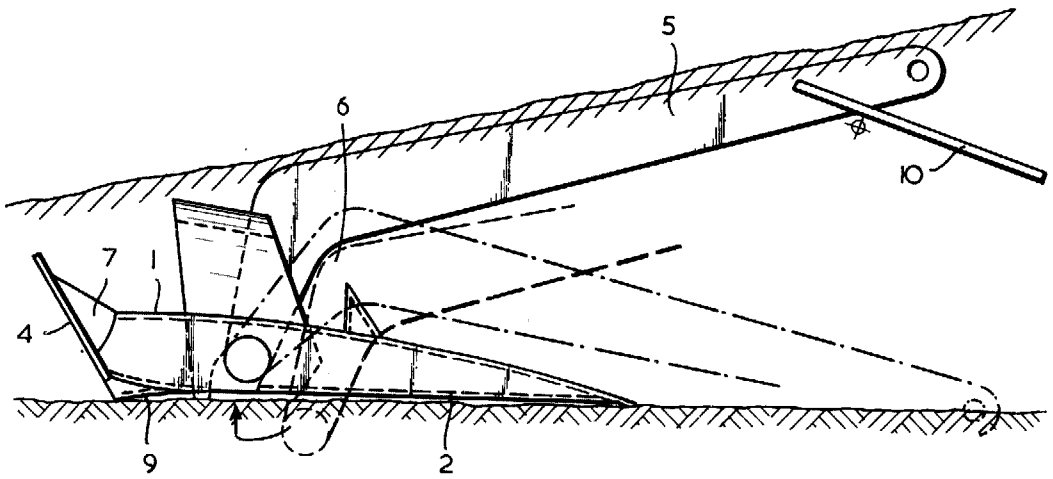
FIG. 3 shows two positions of the anchor in operation.

In FIG. 3 is shown that the fluke has a forwardly and downwardly bending configuration. Due to its bent shape the fluke is very strong. The top and bottom plates converge so that a sharp front edge is formed on the fluke. The supporting ribs 3 terminate at the front side in a sharp point and are deeper in the middle and at the rear side, where the hollow fluke which is hydrofoil-shaped in vertical section, is truncated and closed by an upstanding plate 4 which connects the rear ends of the top plate 1 and the bottom plate 2. The fluke construction has a substantial strength and due to the large fluke surface and the bent shape thereof the holding power of this anchor is several times more than that of the thus far known anchors of the same weight.

The fluke has a central opening, wherein the shank 5 is received, which is pivotally connected to the fluke. The shank has at 6 a sharply downwardly bent rear portion having on its end at each side a trunnium adapted to be received through a bayonet joint slot in a socket in a side plate of the shank support which is welded in the central opening of the fluke.

In FIG. 3 the insertion of a trunnion in a socket from the dotted position of the shank to the position thereof, which is indicated in full lines, is illustrated.

A good penetration is obtained by a smooth fluke surface. As a result thereof the ground can easily pass the fluke. This in contrast to anchors having at the rear side a big crown which counteracts the penetration.

In addition thereto the shank is now bent, forwardly of the hinge, and due to this the shank is deeply buried before the horizontal portion of the shank has reached the ground. The shank is made sharper at the bottom side in order to prevent clod formation. Clod formation opposes the penetration and will cause the anchor to break out. Rearwardly on the upper fluke plate 1 are mounted stabilizers 7. In hard ground an anchor is sooner instable, and therefor two auxiliary stabilizers 8 are mounted lateraly and centrally on the upper fluke plate.

Notwithstanding the fact that the herein described anchor does not have a crown which promotes the break-in, this anchor due to its shape does have a short break-in travelling distance. In other anchors the crown promotes the stopping of the anchor. The fluke of the present anchor will penetrate along a curve because the top plate 1 is bent-up and the bottom plate 2 is either concave or flat. Because of this shape the anchor will work itself automatically with the fluke in a steeper position with respect to the pulling direction, which promotes the holding power. Normal is that as a result of the resistance of the shank the flukes will reduce the relative angle in the pulling direction and will cause the anchor to scrape or hoe.

Because the bent shank of the present anchor is shorter than the shank of other anchors the resistance will be also less than with other anchors, which promotes the digging-in.

The drag of this anchor, with its high holding power, will be shorter than the drag of the former anchors.

In FIG. 3 the anchor is represented by a shank shown in dot-dash-lines as lying on the bottom, and by a shank shown in full lines in a buried position. The anchor is suitable for all types of soil. The high holding power of this anchor is obtained as a result of the large fluke surface, the short drag and good penetration in all types of soil. In mud and soft ground the total fluke surface will be used and the stabilizers 7 will not oppose the penetration. In hard ground a higher holding power will be reached faster and there also no counteraction will be experienced from the bent shank 5 because the horizontal portion of the shank hits the ground when the fluke is already deeply penetrated.

The anchor will be more stable in the hard ground as the auxiliary stabilizers 8 are placed more forwardly than the main stabilizers 7 which, in contrast to the thus far usual construction wherein the stabilizers are located laterally outside the fluke area, are now arranged within the rear corners of the fluke, in a rearwardly and upwardly sloping fin-like position, normal to the final pull direction.

The flat slide plates 9 give the fluke the correct position for digging itself into the ground. In the absence of said plates the anchor could slide over the ground without penetration. Also in mud said flat plates, in combination with the curved fluke, give the anchor the correct position for penetration. In single point-mooring systems, where the type of soil is generally known, said plates can be adopted to the circumstances by varying the size.

As shown in the drawings a manta-shaped auxiliary fluke 10 is hingedly connected to the pad-eye, and it is remarked that said manta-shape could eventually also be given to the main fluke. Because the anchor has an unusual large fluke surface it is possible to place the pennant-wire at the corner of the fluke, which will substantially reduce the required breaking out power. If the anchor is broken out at the pad which is located centrally and rearwardly on the anchor, which is normally done, the breaking out effort will be 30% of the holding power. If the pad-eye at the corner is used a breaking out effort of only 15% of the holding power will be required. The rear plate of the anchor is placed so that the ground will experience little resistance when breaking out the anchor.

The holding power of the herein described anchor is 40 to 55 times its own weight.

By restricting the mounting hole for the shank to the central portion of the fluke it is provided for that the strength of the fluke at the front side is maintained. The pressure of the ground between fluke and shank is thereby relieved, as the ground can flow to the bottom side without the occurrence of clod formation.

Due to the auxiliary fluke 10 which is provided at the front side of the shank, a proportional holding power increase is added to the already existing holding power. An additional advantage is that said auxiliary fluke because of its digging action in hard ground gives the shank the possibility to better penetrate.

The surface of the auxiliary fluke can be an eighth to a third of the main fluke. When the auxiliary fluke becomes larger, the ground will shift as a big slice, and the holding power will be reduced.

What is claimed is:

1. An anchor having a pointed fluke, a shank which is pivotally connected to the fluke, and a ground slide, wherein the fluke has a delta-shaped, closed hollow structure of a forwardly and downwardly curved configuration terminating in a single central point, combined with a ground slide comprising a pair of slide plates, one on each side of its centerline.

2. An anchor according to claim 1, wherein the shank has a sharply bent rear portion to be connected to the fluke and having on its end at each side a trunnion which is adapted to be received through a bayonet joint slot in a socket in a vertical side plate of a shank support in the fluke.

3. An anchor according to claim 1, wherein a manta-shaped auxiliary fluke is hingedly connected to said shank.

4. An anchor according to claim 1, including main stabilizers arranged substantially within the rear corners of the fluke in a rearwardly and upwardly sloping fin-like position, normal to the final pull direction.

* * * * *